United States Patent [19]

Grünewald et al.

[11] Patent Number: 4,562,765

[45] Date of Patent: Jan. 7, 1986

[54] AMMUNITION BUNKER IN WHICH THE SHELLS ARE INSERTED IN INDIVIDUAL STORAGE TUBES

[75] Inventors: Peter Grünewald, Fuldabrück; Heinz-Jürgen Schlömer, Vellmar, both of Fed. Rep. of Germany

[73] Assignee: Wegmann & Co. GmbH, Kassel, Fed. Rep. of Germany

[21] Appl. No.: 560,020

[22] Filed: Dec. 9, 1983

[51] Int. Cl.[4] ..... F42B 37/02

[52] U.S. Cl. ..... 89/34; 206/3

[58] Field of Search ..... 89/34, 36 K, 36 H; 188/67, 74; 221/81; 206/3; 312/45, 72

[56] References Cited

U.S. PATENT DOCUMENTS 4,388,854 6/1983 Dabrowski et al. ..... 89/34 X 4,454,799 6/1984 Gilvydis ..... 89/34 X

FOREIGN PATENT DOCUMENTS 3125406 2/1983 Fed. Rep. of Germany ..... 206/3

*Primary Examiner*—David H. Brown

*Attorney, Agent, or Firm*—Sprung Horn Kramer & Woods

[57] ABSTRACT

An ammunition bunker has a plurality of storage tubes arrayed in rows next to and above each other. A doorway at the rear ends of the tubes is provided through which shelves are inserted and removed from the tubes. The doorway extends over an area which is less than that of the array of tubes such that given tubes lie outside the area of the doorway. In order to access these tubes, the given tubes are mounted at the front ends thereof for pivoting movement at the rear ends of each towards the doorway. Storage tubes disposed adjacent the given tubes in the direction of pivot have cutout portions so as to enable the extraction openings of the pivoted given storage tubes to be in approximately the same position as in the extraction openings of the cutout storage tubes.

6 Claims, 5 Drawing Figures

AMMUNITION BUNKER IN WHICH THE SHELLS ARE INSERTED IN INDIVIDUAL STORAGE TUBES

BACKGROUND OF THE INVENTION

The invention relates to an ammunition bunker in which the shells are inserted in individual storage tubes arrayed in rows one next to and above another. The ammunition bunker can be positioned for example in the turret of a tank or other battle system. There are doors for removing the ammunition, which is located as a rule in the storage tubes in such a way that the points of the rounds point away from the doors, on the side of the bunker facing a combat space. Thus, the doors face the base of the shells. Now, for ammunition to be removed from even the outermost or topmost storage tubes, the doors must leave the overall front of the the bunker, which on the one hand makes for problems because the space is often restricted and on the other compels the loader to reach far up or to one side which is strenuous and tiring and causes delays. The invention is intended to allow the doors of the ammunition bunker to be kept as small as possible and to offer the user the optimum human-engineering potential when both loading and unloading the bunker.

SUMMARY OF THE INVENTION

This object is attained in accordance with the invention in that the loading tubes at a distance from the door can be pivoted around their front ends toward the door. The storage tubes to the side of the door can be pivoted horizontally around their front ends toward the door and the storage tubes above the door can be pivoted vertically around their front ends toward the door. To prevent adjacent storage tubes from getting in the way of this pivoting, each of the storage tubes located in front of one of the pivoting storage tubes in the direction of pivot can be cut out in a practical way so that the extraction openings of the pivoted storage tubes will be approximately in the same position as the extraction openings of the adjacent cut-out storage tubes. It can in this case be necessary for the outermost storage tubes to execute two pivoting motions, to be capable of pivoting, in other words, far enough for their extraction openings to arrive at the same point as those of the third-next tube. To allow these pivoting motions, the storage tubes adjacent to the pivoting storage tubes can be cut out so that the pivoting storage tubes will pivot into the adjacent tube to a certain extent until their extraction opening is at the same point as that of the adjacent tube. The storage tubes with adjacent pivoting storage tubes are cut out at the side, whereas the storage tubes that have pivoting storage tubes vertically above them are cut out at the top. The cutouts must be no larger than necessary to allow the pivoting tubes to pivot in, meaning that the lines of the cut will extend at an angle to the axis of the tube as will be described in greater detail in what follows. For the ammunition to be held securely even in the storage tubes that have been partly cut out and to maintain its position even when shaken, supporting sections with a shape that conforms to that of the portion of the wall cut out and hence at least to some extent replacing the missing portion are in a practical way positioned at the pivoting storage tubes facing the cutouts in the cut-out storage tubes. When two pivoting storage tubes are adjacent to a non-pivoting storage tube, the cutout in the non-pivoting tube will be dimensioned so that both adjacent storage tubes can be pivoted in until their extraction openings are at approximately at the same point as those of the non-pivoting tube and the first pivoting tube must also be cut out so that the second pivoting storage tube also can be brought into a position in which its extraction opening is approximately at the same point as that of the non-pivoting storage tube.

To facilitate the pivoting in and back of the storage tubes springs are provided in a practical way to draw the tubes that pivot horizontally into the position pivoted toward the door, while they pull the vertically pivoting storage tubes upward, the spring tension being selected to act as weight compensation in such a way that the weight of a storage tube containing a shell is not completely compensated and it will tend to move down, whereas the weight of an empty tube will be overcompensated by the force of the springs so that the empty tube will move back up into its rest position. To prevent the storage tubes from swinging back and forth and colliding when shaken arresting levers are also provided in a practical way to secure the storage tubes in their unpivoted position.

BRIEF DESCRIPTION OF THE DRAWINGS

FIG. 3 illustrates the storage tubes in FIG. 2 with the pivoting tube pivoted in.

DETAILED DESCRIPTION OF THE INVENTION

Figure 1:
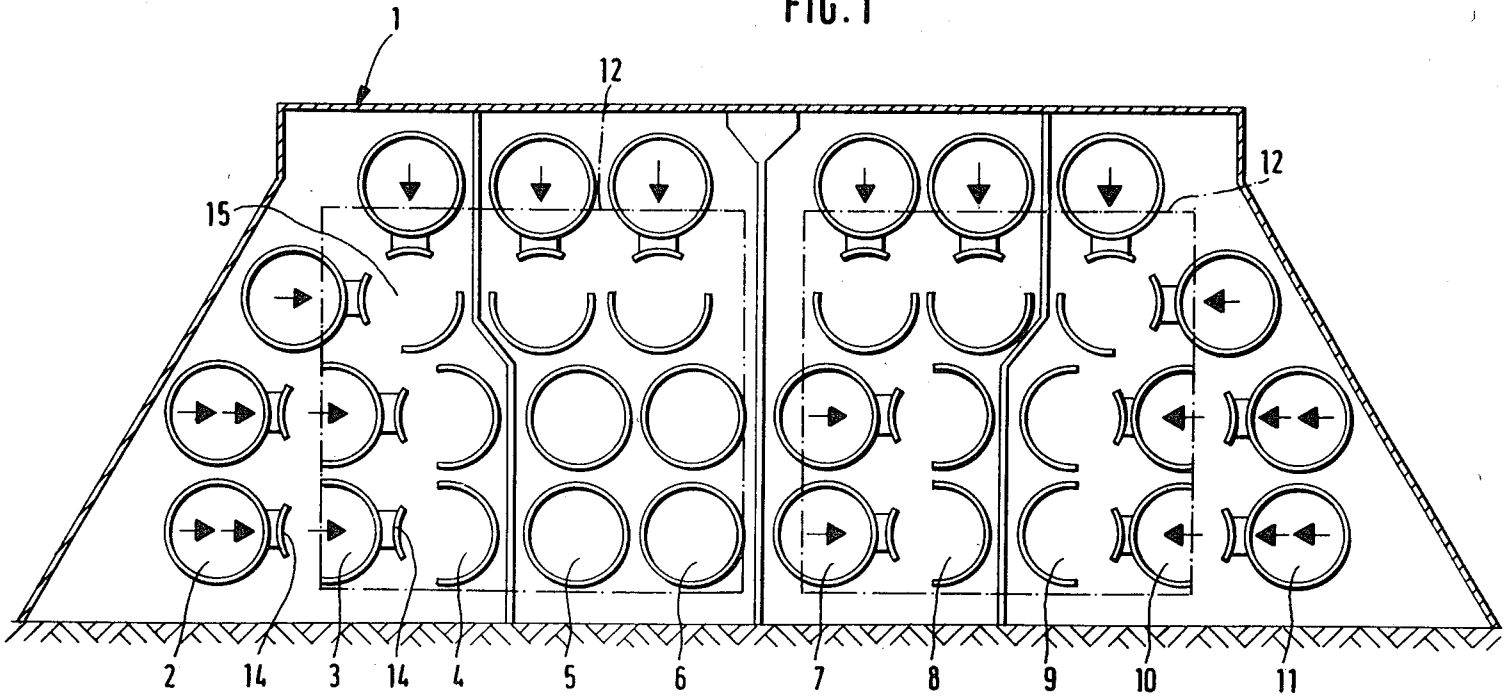
FIG. 1 is a front view of an ammunition bunker in accordance with the invention.

The bunker 1 in FIG. 1 comprises a number of storage tubes. The tubes in the bottom row are numbered 2 through 11. On the front of the bunker are two doors through which the ammunition can be removed from a combat space that is not illustrated. The dimensions of the doorways are indicated by the dot-and-dash line 12. Obviously the shells can be removed from storage very easily when the doors are open. The shells cannot, however, be removed directly from storage tubes 2 and 3 on the left, from storage tube 7 in the middle, or from storage tubes 10 and 11 on the right when the doors are open. Storage tubes 3, 7, and 10 are accordingly capable of pivoting horizontally, upon which their ends facing the doorways enter the cutouts in adjacent storage tubes 4, 8, or 9, so that the extraction openings in storage tubes 3, 7, and 10 will be located entirely in front of the doorways and hence in the vicinity of the extraction openings of stationary storage tubes 4, 8, or 9. The extraction openings of storage tubes 2 and 11 are, as illustrated in FIG. 1, entirely covered up by the wall of the bunker. For shells to be removed from these storage tubes it is not sufficient to pivot them in one step as far as each adjacent storage tube, tube 2 up to tube 3 for instance, but storage tube 2 must be pivoted in two steps up to storage tube 3, whereby storage tube 3 must likewise be pivoted up to storage tube 4 ahead of time. Obviously, a pivoting storage tube can only be pivoted in when the adjacent cut-out no longer contains a shell, meaning that the ammunition has already be removed from this tube. The same holds, as will be evident from FIG. 1, for the second and third row from the bottom as for the bottom row.

The storage tubes in the top row are located as is also evident somewhat above the doorways. For this reason the storage tubes in the top row can be pivoted down vertically, upon which their extraction openings will be entirely in the vicinity of the doorways and will each be positioned at the same point as the extraction opening of each underlying, non-pivoting storage tube.

For the shells to be held securely enough in the partially cut-out storage tubes, supporting sections 14 that are shaped to conform to the missing portion of the wall of the cut-out storage tubes are positioned at the pivoting storage tubes so that even the shells in the cut-out storage tubes will be securely held in their rest position. It should be noted that storage tube 15 in the third row from the bottom has to have two cutouts because the both the storage tube to the left of it, which pivots horizontally, and the storage tube above it, which pivots vertically, must enter it so that ammunition can be extracted.

Figure 2:
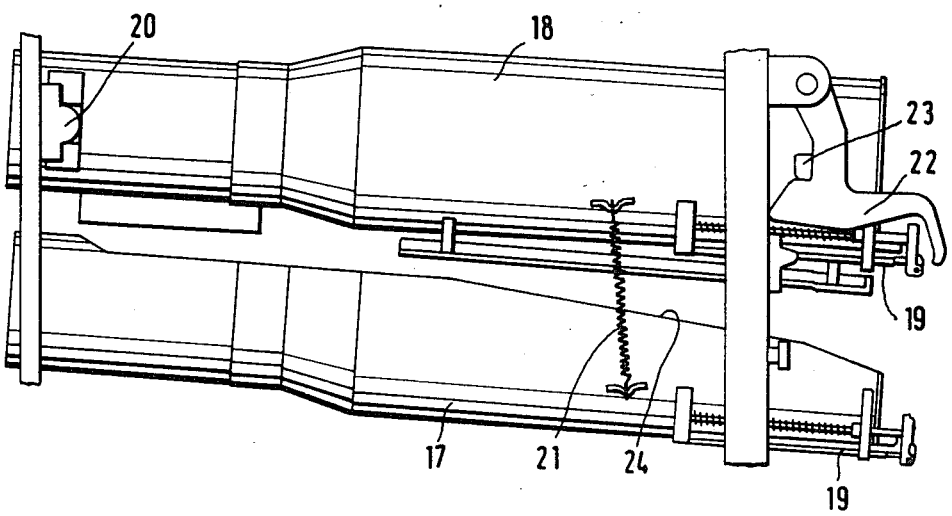
FIG. 2 is a partial view of two storage tubes, one of them capable of being pivoted.
Figure 3:
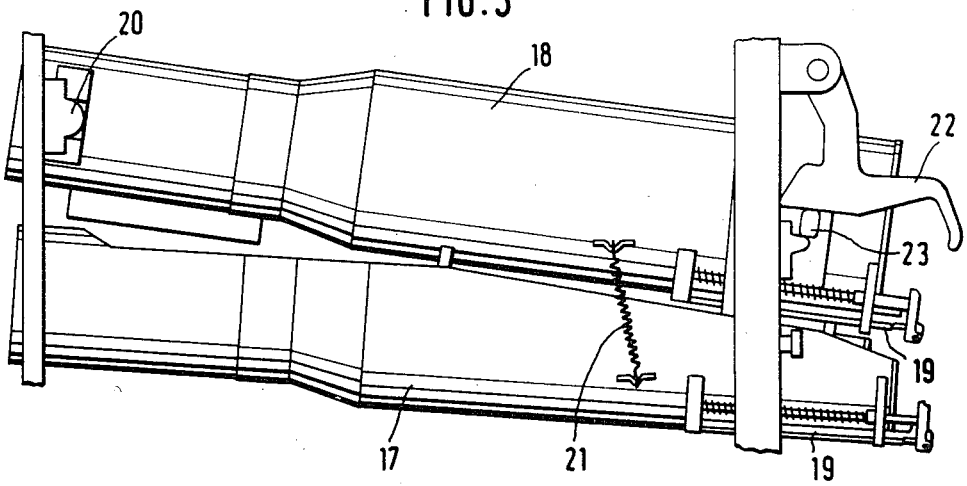

FIG. 2 shows a non-pivoting storage tube 17 and an adjacent, horizontally pivoting storage tube 18. There are at both storage tubes devices 19 that secure the shells in the storage tubes and extract a piece out of the tubes when necessary so that they can be easily grasped. Storage tube 18 pivots around a point 20. A spring 21 tensions storage tube 18 against stationary storage tube. An arresting lever 22, which engages the rear of a cam 23 on storage tube 18, secures the tube in the position illustrated in FIG. 2. The side of storage tube 17 that faces pivoting storage tube 18 is cut out to the extent that, as illustrated in FIG. 3, storage tube 18 can pivot into stationary and cut-out storage tube 17 once arresting lever 22 has been released so that the shell can now also be extracted from storage tube 18 with device 19 once a shell has been extracted from storage tube 17.

Figure 4:
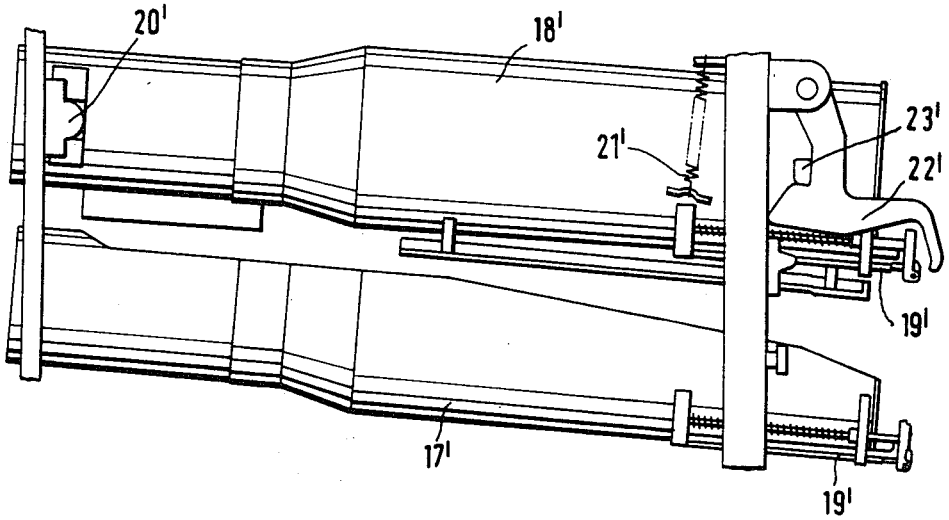
FIG. 4 is a partial view of two storage tubes,one of them capable of being vertically pivoted.
Figure 5:
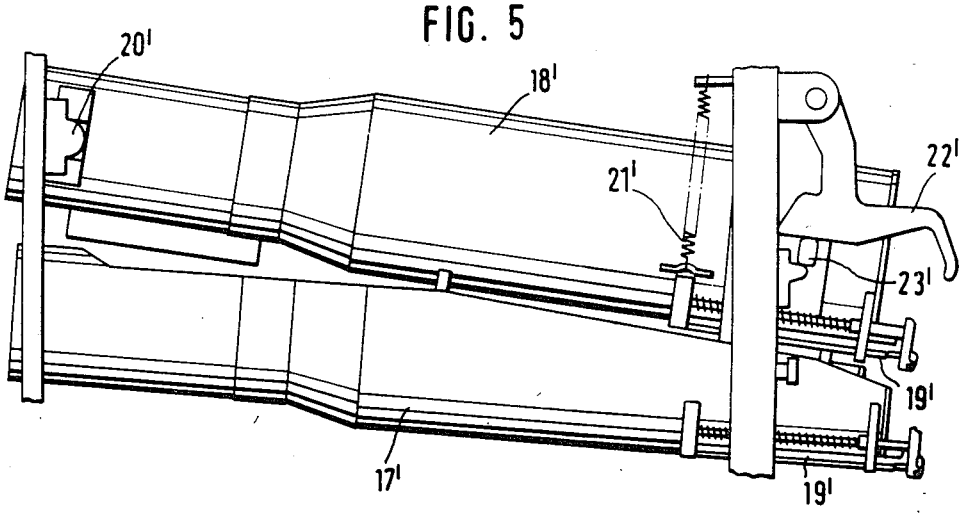
FIG. 5 illustrates the storage tubes in FIG. 4 with the pivoting tube pivoted down.

FIGS. 4 and 5 show vertically pivoting storage tubes 18' which pivot about pivot 20' toward stationary storage tubes 17'. Springs 21' pull the vertically pivoting storage tubes 18' upward, and the spring tension is selected to act as weight compensation in such a way that the weight of the storage tube 18' containing a shell is not completely compensated for and it will tend to move down, whereas the weight of an empty tube will be overcompensated for by the force of the springs 21' so that the empty tube 18' will move back up into its rest position. To prevent storage tubes 18' from swinging back and forth and colliding when shaken, arresting levers 22' and cam 23' are provided as in the embodiment of FIGS. 2 and 3 as is the device 19' for extraction as in the embodiment of FIGS. 2 and 3.

The way the system is managed will now be described.

When the bunker is to be loaded, when, that is, all the storage tubes are empty, the pivoting storage tubes are brought into the pivoted-in position and filled with shells. Thus, the pivoted-in storage tube 2 is filled first in the bottom row for example and returned into its rest position until its arresting lever 22 snaps into place and then the pivoted-in storage tube 3 filled and likewise returned to its rest position, upon which it becomes possible for the first time to fill stationary storage tubes 4, 5, and 6. The same procedure is followed for the other rows of storage tubes, with of course the vertically pivoting storage tubes in the top row being filled first and only then the storage tubes in the next lowest row. The reverse procedure is followed in removing ammunition. Here the ammunition is removed first from the stationary storage tubes, from tubes 4, 5, and 6 for example, and only when ammunition has been removed from storage tube 4 can storage tube 3 be pivoted in and a shell be extracted from it and then storage tube 2 be pivoted in and a shell extracted from it as well.

We claim:

1. An ammunition bunker comprising: a plurality of storage tubes arrayed in rows next to and above each other; and each receptive of shells therein through an extraction opening at the rear end thereof; a doorway at the rear ends of the tubes and through which shells are inserted and removed from the tubes, wherein the doorway extends over an area which is less than that of the array of tubes, whereby given tubes lie outside the area of the doorway; means mounting the given tubes at the front end thereof for pivoting movement of the rear end toward the doorway area; and wherein storage tubes disposed adjacent the given tubes in the direction of pivot have cut out portions to enable the extraction openings of the pivoted given storage tubes to be in approximately the same position as the extraction openings of the cut out storage tubes.

2. The ammunition bunker as in claim 1, wherein supporting sections with a shape that conforms to that of the cut out portion are positioned at the pivoting storage tubes facing the cut out portions of the cut out storage tubes.

3. The ammunition bunker as in claim 1, wherein, of three storage tubes that are horizontally adjacent, the storage tubes nearest the doorway cannot pivot and is cut out so that the extraction openings of the two adjacent horizontally pivoted given storage tubes are located at approximately the same point as the extraction opening of the non-pivoting storage tube and the first pivoting storage tube is cut out so that the extraction opening of the third storage tube is, when it is pivoted, likewise located at approximately the same point as the extraction opening of the first, non-pivoting storage tube.

4. An ammunition bunker comprising: a plurality of storage tubes arrayed in rows next to and above each other and each receptive of shells therein through an extraction opening at a rear end thereof; a doorway at the rear ends of the tubes and through which shells are inserted and removed from the tubes, wherein the doorway extends over an area which is less than that of the array of tubes, whereby given tubes lie above and to the sides of the doorway; means mounting the front ends of the given tubes at the sides of the doorway for horizontal pivoting toward the doorway and the front ends of the given tubes above the doorway for vertical pivoting toward the doorway; and wherein the storage tubes disposed below the given tubes that pivot vertically and the storage tubes disposed adjacent the given tubes that pivot horizontally have cut out portions to enable the extraction openings of the pivoted given tubes to be in approximately the same position as the extraction openings of the cut out storage tubes.

5. The ammunition bunker as in claim 4, further comprising springs urging the storage tubes that can pivot horizontally into the position pivoted toward the doorway and springs urging the storage tubes that can pivot vertically upwardly and which do not completely compensate for the weight of a storage tube filled with a shell and overcompensate for the weight of an empty storage tube.

6. The ammunition bunker as in claim 4, further comprising springs urging the storage tubes that can pivot horizontally into the position pivoted toward the door arresting levers for securing same in the unpivoted position and spring urging the storage tubes that can pivot vertically upwardly and which do not completely compensate for the weight of a storage tube filled with a shell but overcompensate for the weight of an empty storage tube, and arresting levers for securing the vertically pivoted tubes in the upper, unpivoted position.

* * * * *